US009376845B2

(12) United States Patent
Sawaguchi

(10) Patent No.: US 9,376,845 B2
(45) Date of Patent: Jun. 28, 2016

(54) HINGE DEVICE AND HOUSING

(71) Applicant: Yamaha Corporation, Hamamatsu-shi, Shizuoka (JP)

(72) Inventor: Hidefumi Sawaguchi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/406,929

(22) PCT Filed: Jun. 11, 2013

(86) PCT No.: PCT/JP2013/066042

§ 371 (c)(1),
(2) Date: Dec. 10, 2014

(87) PCT Pub. No.: WO2013/187393

PCT Pub. Date: Dec. 19, 2013

(65) Prior Publication Data

US 2015/0167367 A1 Jun. 18, 2015

(30) Foreign Application Priority Data

Jun. 11, 2012 (JP) ..... 2012-132231

(51) Int. Cl.
*E05D 3/18* (2006.01)
*E05D 3/02* (2006.01)
(Continued)

(52) U.S. Cl.
CPC *E05D 3/18* (2013.01); *E05D 3/022* (2013.01); *E05D 7/1061* (2013.01); *E06B 3/34* (2013.01);
(Continued)

(58) Field of Classification Search
CPC ..... E05D 3/18; E05D 7/1061; E05D 3/022; E05D 2007/1094; E05D 7/081; E06B 3/34; E05Y 2900/538; E05Y 2900/602; E05Y 2900/20; Y10T 16/5443; Y10T 16/5448
USPC ..... 49/381, 389, 399, 463; 16/267, 342, 16/348, 356, 357, 358, 360, 361; 312/323, 312/303, 405
See application file for complete search history.

(56) References Cited

U.S. PATENT DOCUMENTS 552,485 A * 12/1895 Rich ..... E05D 3/18 16/358
1,075,130 A * 10/1913 Streberger ..... E05D 3/18 16/358

(Continued)

FOREIGN PATENT DOCUMENTS

CN 2727480 Y 9/2005
JP 63-101670 U 7/1988

(Continued)

OTHER PUBLICATIONS

International Search Report (PCT/ISA/210) dated Jul. 9, 2013, with English translation (five (5) pages).

(Continued)

*Primary Examiner* — Justin Rephann
(74) *Attorney, Agent, or Firm* — Crowell & Moring LLP

(57) ABSTRACT

There is provided a hinge device that supports a first member and a second member to be rotatable. The hinge device includes a first guide groove and a second guide groove that are formed on the first member substantially parallel to each other, and a first pin that is provided on the second member and is slidably engaged with the first guide groove and a second pin that is provided on the second member and is slidably engaged with the second guide groove. The first guide groove includes a first end portion with which the first pin rotatably comes into contact, and the second guide groove includes a second end portion where a movement space in which the second pin is disposed so as to rotate around the first pin when the first pin is disposed at the first end portion is formed.

11 Claims, 7 Drawing Sheets

(51) Int. Cl.
*E05D 7/10* (2006.01)
*E06B 3/34* (2006.01)

(52) U.S. Cl.
CPC ..... *E05D 2007/1094* (2013.01); *E05Y 2900/20* (2013.01); *E05Y 2900/538* (2013.01); *E05Y 2900/602* (2013.01); *Y10T 16/528* (2015.01); *Y10T 16/5444* (2015.01)

(56) References Cited

U.S. PATENT DOCUMENTS 2,206,499 A * 7/1940 Dumelin ..... E05D 1/04 16/358
2,435,670 A * 2/1948 Buehler ..... A01C 15/00 16/358
2,584,173 A * 2/1952 Van Fowler ..... A47B 88/06 16/357
2,793,387 A * 5/1957 Odell ..... E05D 3/18 16/358
2,867,839 A * 1/1959 Squire ..... E05D 3/18 16/358
2,869,958 A * 1/1959 Hough ..... H05K 7/16 312/303
3,065,498 A * 11/1962 Johnson ..... E05D 1/04 16/359
4,316,082 A * 2/1982 Fritz ..... A47B 21/0314 108/32
4,368,866 A * 1/1983 Urban ..... B60R 11/02 224/929
5,169,221 A * 12/1992 Wheeler ..... A47B 88/06 16/358
5,603,682 A * 2/1997 Grider ..... A47C 7/40 248/292.14
5,884,366 A * 3/1999 Jeong ..... E05D 7/123 16/266
6,520,558 B1 * 2/2003 Katterloher ..... B60J 7/1621 16/358
6,611,424 B2 * 8/2003 Huang ..... H05K 7/1421 248/224.51
6,846,052 B2 * 1/2005 Kelley ..... A47B 21/0314 108/93
6,945,621 B2 * 9/2005 Shin ..... E05D 3/18 16/359
7,338,107 B1 * 3/2008 Wilcox ..... E05D 3/022 296/57.1
7,536,752 B2 5/2009 Laursen
7,757,349 B2 7/2010 Laursen
8,113,478 B2 * 2/2012 Hsiao ..... B65D 19/38 248/220.22
8,338,767 B2 * 12/2012 Kulkarni ..... E05D 3/022 16/358
2002/0104191 A1 * 8/2002 Matteau ..... E05D 3/18 16/255
2002/0164197 A1 * 11/2002 Lee ..... E05D 3/022 403/65
2004/0237252 A1 * 12/2004 Hoshide ..... A47B 88/047 16/72
2005/0248245 A1 * 11/2005 Ceccarelli ..... A47B 46/005 312/323
2006/0168759 A1 8/2006 Laursen
2008/0301909 A1 * 12/2008 Chien ..... G06F 1/1622 16/362
2009/0183341 A1 * 7/2009 Chuan ..... G06F 1/1601 16/358
2009/0223022 A1 9/2009 Laursen
2010/0103601 A1 * 4/2010 Wang ..... E05D 3/18 361/679.02
2012/0025686 A1 * 2/2012 Darney ..... E05D 3/18 312/405

FOREIGN PATENT DOCUMENTS

JP 2-117238 U 9/1990
JP 4-309681 A 11/1992
JP 2005-146625 A 6/2005
JP 2005-232875 A 9/2005
JP 2007-221230 A 8/2007
JP 4203196 B2 12/2008

OTHER PUBLICATIONS

Written Opinion (PCT/ISA/237) dated Jul. 9, 2013, with English translation (six (6) pages).
Extended European Search Report issued in counterpart European Application No. 13804655.2 dated Jan. 27, 2016 (seven (7) pages).
Chinese Office Action issued in counterpart Chinese Application No. 201380029888.5 dated Mar. 8, 2016 with English translation (15 pages).

* cited by examiner

HINGE DEVICE AND HOUSING

TECHNICAL FIELD

The present invention relates to a hinge device that is used for audio equipment, a cabinet, a console box of an automobile, and the like in which a panel, a cover, or the like is mounted on a body part so as to be openable and closable, and supports a first member and a second member so as to allow the first and second members to be rotatable, and more particularly, to a hinge device of which a fulcrum of rotation can slide and relates to a housing using the hinge device.

BACKGROUND ART

As a hinge device that is used for audio equipment, a cabinet, a console box of an automobile, and the like in which a panel, a cover, or the like is mounted on a body part so as to be openable and closable, there is a hinge device of which a fulcrum for opening and closing can slide.

For example, Patent Literature 1 discloses a slide hinge that guides the rotation of a rotating body relative to a stationary body by two links, and a torsion spring is provided so as to pinch these two links and a middle portion of the torsion spring is supported by pins.

Further, Patent Literature 2 discloses a vehicle interior member that allows pins to be engaged with two guide grooves, respectively, allows these pins to linearly move along the guide grooves and to rotate in the guide grooves, and allows a lid body to be opened and closed without any interference between the lid body and the body part.

CITATION LIST

Patent Literature

Patent Literature 1: JP-A-4-309681
Patent Literature 2: Japanese Patent No. 4203196

SUMMARY OF INVENTION

Technical Problem

However, since the number of pins supporting the two links is large in the slide hinge disclosed in Patent Literature 1, the structure of the slide hinge is complicated. Since the lid body needs to be bent in the vehicle interior member disclosed in Patent Literature 2 as shown in FIG. 4 of Patent Literature 2 so that a large space is formed between the body part and the lid body, an increase in the size of a device is caused.

The present invention has been made in consideration of the above-mentioned circumstances, and an object of the present invention is to provide a hinge device that can be opened and closed without any interference between members and can achieve a reduction in size and space saving by a simple mechanism, and to provide a housing using the hinge device.

Solution to Problem

According to an aspect of the present invention, there is provided a hinge device that supports a first member and a second member so as to allow the first and second members to be rotatable. The hinge device includes a first guide groove and a second guide groove that are formed on the first member in substantially parallel to each other, and a first pin that is provided on the second member and is slidably engaged with the first guide groove and a second pin that is provided on the second member and is slidably engaged with the second guide groove. The first guide groove includes a first end portion with which the first pin rotatably comes into contact, and the second guide groove includes a second end portion where a movement space in which the second pin is disposed so as to rotate around the first pin when the first pin is disposed at the first end portion of the first guide groove is formed.

Before the pins of the hinge device are moved along both the guide grooves, the second pin can be rotated in the movement space of the second end portion around the first pin disposed at the first end portion in a closed state of fixing components of the first and second members. Accordingly, it is possible to separate one end portion of the second member so that one end portion of the second member floats away from the first member by rotating the second pin. Accordingly, it is possible to smoothly perform a subsequent opening operation, which is accompanied by sliding, without any interference between both the members. In this case, since a part of both the members are separated from each other at the first stage of the opening operation, a large space does not need to be formed in advance between both the members unlike in a device disclosed in Patent Literature 2. Accordingly, it is advantageous in reducing the size of the device and saving space.

In the hinge device according to the aspect of the present invention, the first and second guide grooves may be disposed so as to gradually approach each other toward an opposite side from the first and second end portions, respectively.

The first member can be rotated about the first pin at the first end portion and the second end portion. However, if the first member is rotated even during a sliding operation, there is a concern that an opening operation may be hindered by the interference between both the members. In the hinge device according to the aspect of the present invention, both the guide grooves are disposed so as to gradually approach each other toward an opposite side from the first and second end portions. Accordingly, when the pins are moved, the second member is gradually inclined with respect to the first member. Therefore, the interference between both the members is prevented by the restriction of the careless rotation of the second member. As a result, it is possible to smoothly and reliably perform a sliding operation.

In the hinge device according to the aspect of the present invention, a rotation end portion with which the first pin rotatably comes into contact may be formed on a side of the first guide groove opposite to the first end portion, and a first relief groove portion, in which the second pin is disposed so as to rotate around the first pin when the first pin is disposed at the rotation end portion, may be formed on a side of the second guide groove opposite to the second end portion.

It is possible to widely open the second member from the first member by rotating the first member about the first pin at the rotation end portion after moving the first member along the guide grooves from the closed state of the first and second members. Since an operation for rotating the first member is performed after the first and second members are significantly separated from each other, it is possible to prevent any interference between the first and second members.

In the hinge device according to the aspect of the present invention, a first open end through which the first pin is extracted from the first member may be connected to the rotation end portion. Further, a second relief groove portion, which guides the first pin to the first open end from the rotation end portion when the second pin is removed from the second guide groove, may be formed. Furthermore, a second open end through which the second pin is extracted from the first member may be connected to the first relief groove portion.

Since the second member can be separated from the first member after being widely opened from the first member, it is possible to prevent any interference between the members and to easily perform an operation for separating the member.

Further, a body part and a panel part, which forms a front surface portion of the body part, of a housing according to another aspect of the present invention are openably and closably supported by the hinge device. A part of any one of the body part and the panel part may be the first member and a part of the other thereof may be the second member.

Advantageous Effects of Invention

According to the present invention, since it is possible to open and close the first and second members without any interference between the fixing components of the first and second members and to rotate the second member at the first stage of an opening operation so that the second member is separated from the first member, a space or the like, which is disclosed in Patent Literature 2 and required for an opening operation, does not need to be formed. Further, since the hinge device has a simple structure that includes two guide grooves and two pins, the hinge device can achieve a reduction in size and space saving.

DESCRIPTION OF EMBODIMENTS

An embodiment of the present invention will be described below with reference to the drawings.

Figure 2:
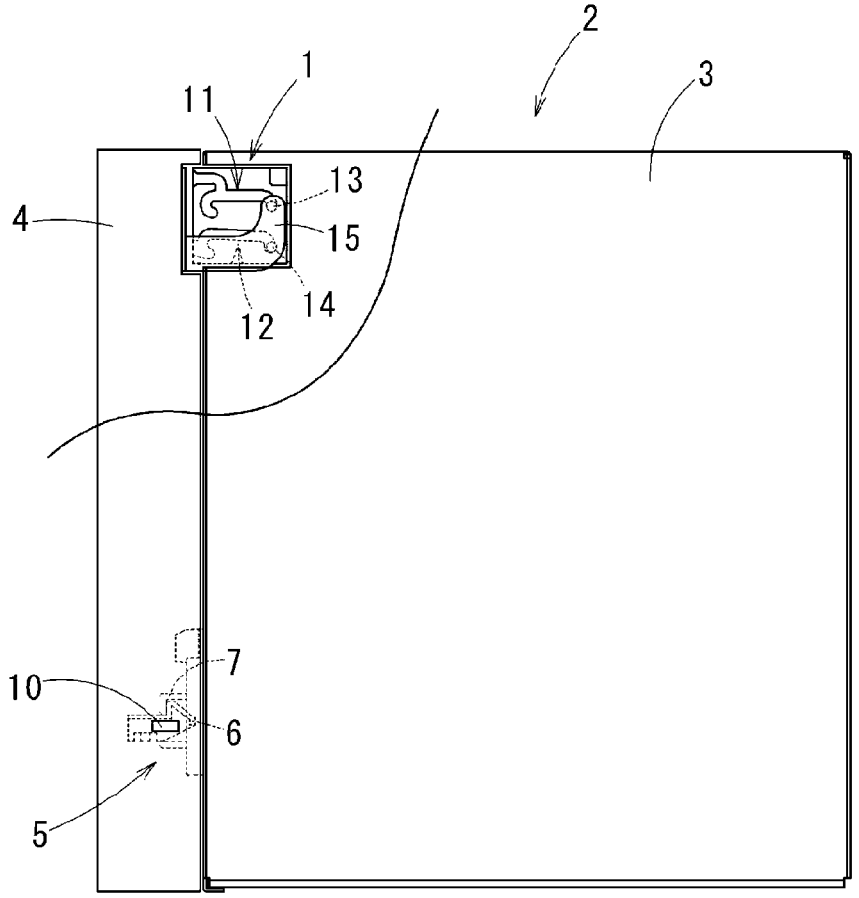
FIG. 2 is a front view of audio equipment including the hinge device of FIG. 1 and shows the broken-out section of a portion corresponding to the hinge device.
Figure 3:
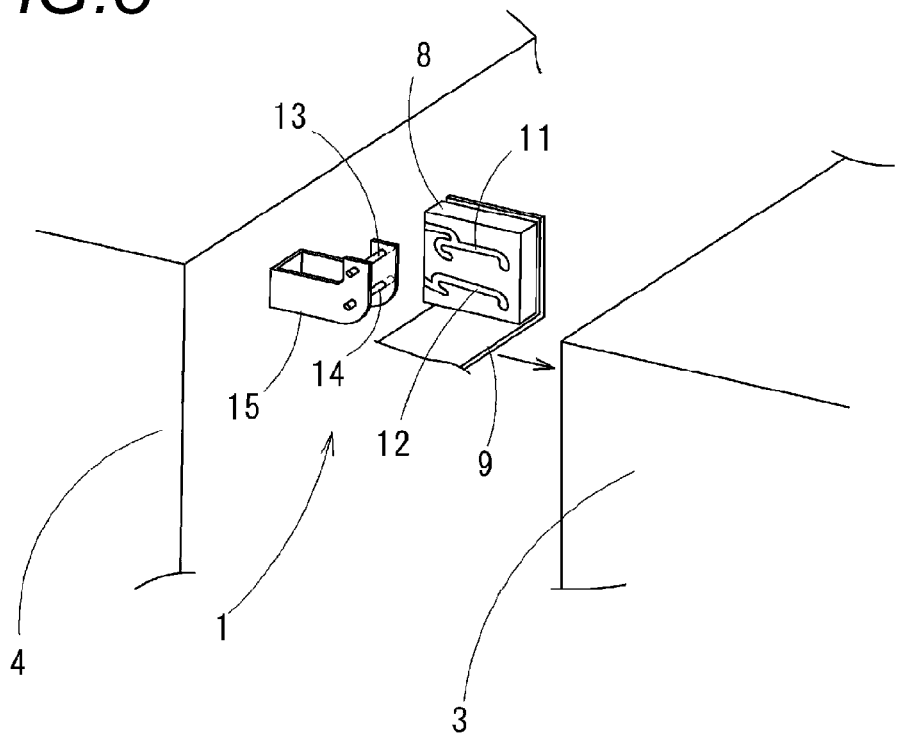
FIG. 3 is a partially exploded perspective view of the hinge device of FIG. 2.

As shown in FIGS. 2 and 3, a hinge device 1 of this embodiment supports a panel part 4, which forms the front surface of a housing 2, so that the panel part 4 can open and close a body part 3 of the housing 2 of audio equipment.

The housing 2 of this audio equipment is formed in a rectangular parallelepiped shape as a whole. A part, which has a predetermined thickness, of a front surface portion of the housing is separated from the body part 3 as the panel part 4, is openably and closably supported by the hinge device 1, and is locked in a closed state by a locking device 5 at the time of the closed state. Meanwhile, the panel part 4 is provided with various operation parts, a display part, and the like, and the body part 3 and the panel part 4 are connected to each other by a transmission mechanism (not shown) that is formed of a detachable cable or the like.

The locking device 5 includes a hook 6 that is provided on the panel part 4 and a locking piece 7 that is provided on the body part 3. The hook 6 is engaged with the locking piece 7 in a closed state, so that the closed state is locked. When the panel part 4 is rotated so that a lower end portion of the panel part 4 slightly floats from the body part 3 while an unlocking button 10 is pressed from this locked state, the locked state is released. Specifically, the hook 6 is generally biased toward an upper position where the hook 6 is engaged with the locking piece 7 by an elastic body (not shown), and a part of the hook 6 is exposed to the side surface of the panel part 4 and is connected to the unlocking button 10 that is provided on the side surface of the panel part 4. Further, when the unlocking button 10 is pressed, the hook 6 is slightly moved downward and is released from a state in which the hook 6 and the locking piece 7 are engaged with each other.

Figure 1:
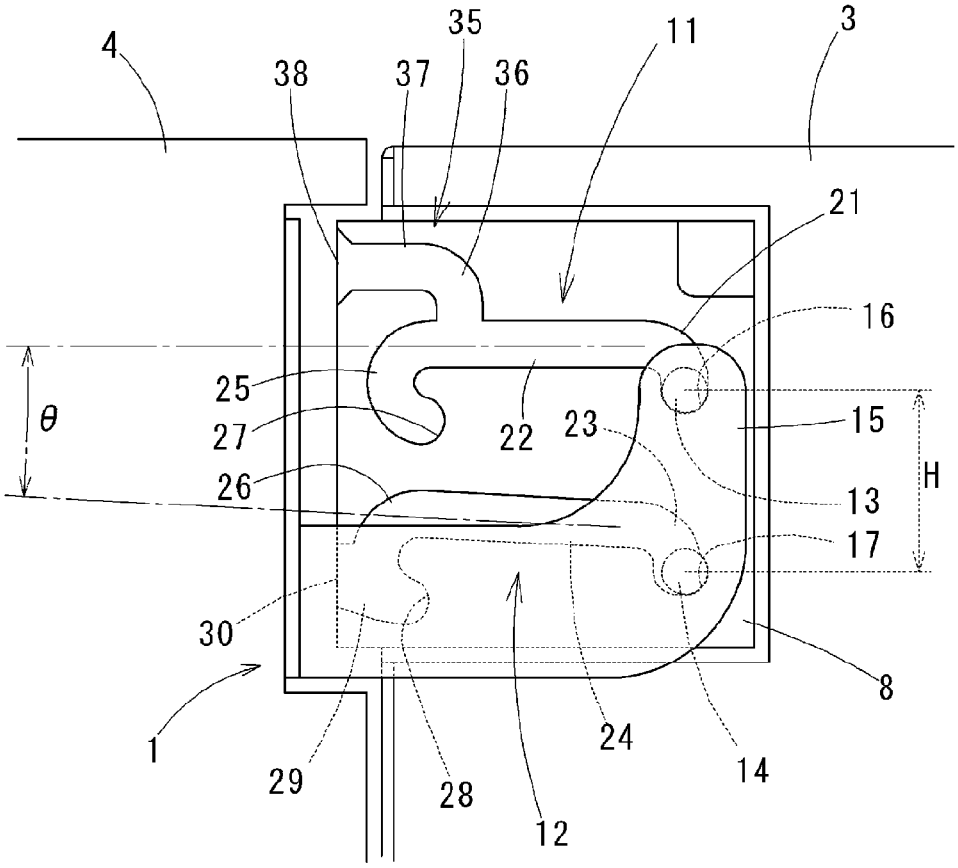
FIG. 1 is a front view of a hinge device according to an embodiment of the present invention.

As shown in FIG. 1, the hinge device 1 includes first and second guide grooves 11 and 12 that are formed on the surfaces of blocks 8 fixed to the body part 3 and made of a resin or the like, and first and second pins 13 and 14 that are formed on a stay 15 fixed to the panel part 4 and are engaged with the respective guide grooves 11 and 12. In the present invention, a member on which the pins are formed is referred to as a first member and a member on which the guide grooves are formed is referred to as a second member. That is, in this embodiment, the stay 15 is referred to as the first member and the blocks 8 are referred to as the second member.

The two pins 13 and 14, which are provided on the panel part 4, are formed on the stay 15 so as to be parallel to each other. In the embodiment shown in the drawings, the stay 15 is formed so as to be bent in an L shape and the two pins 13 and 14 are fixed to an end portion of the stay 15 so as to be lined up in a substantially up-and-down direction parallel to the front surface of the panel part 4. A distance (pitch) between these pins 13 and 14 in the up-and-down direction is denoted by H.

Both the guide grooves 11 and 12 are formed on the surfaces of the blocks 8. In this case, the hinge device 1 has a structure in which two blocks 8 are fixed to a bracket 9 mounted on the body part 3 so as to face each other (only one block is shown and the other block is not shown in FIG. 3), the guide grooves 11 and 12 are formed on the surfaces, which face each other, of the blocks 8 so as to be disposed in a mirror-image relationship obtained from mirror transfer, the pins 13 and 14 held on the stay 15 are disposed between the blocks, and both end portions of these pins 13 and 14 are engaged with the guide grooves 11 and 12. Since the guide grooves 11 and 12 of both the blocks 8 satisfy the mirror-image relationship, an engagement state between one block and the pins 13 and 14 will be described below.

The first guide groove 11 of both the guide grooves 11 and 12 is disposed above the second guide groove 12. A first end portion 16, in which the first pin 13 is disposed when the panel part 4 and the body part 3 are in the closed state, is formed at the first guide groove 11, and a second end portion 17, in which the second pin 14 is disposed when the panel part 4 and the body part 3 are in the closed state, is formed at the second guide groove 12.

In this case, the first and second end portions 16 and 17 are disposed at substantially the same distance from the front surface of the body part 3 so as to be lined up in the up-and-down direction (vertical direction), and the distance between the first and second end portions 16 and 17 in the up-and-down direction is set to be equal to the distance between both the pins 13 and 14. Further, the first end portion 16 of the first guide groove 11 is formed in the shape of an arc-shaped terminating end having substantially the same inner diameter as the diameter of the first pin 13 so that the first pin 13 rotatably comes into contact with the first end portion 16, and the second end portion 17 of the second guide groove 12 forms an oval movement space in which the second pin 14 can be moved when the panel part is rotated about the first pin 13 at the first end portion 16 of the first guide groove 11.

Furthermore, a linear groove portion 22 of the first guide groove 11 continues from the first end portion 16 through an arc-shaped groove portion 21, and a linear groove portion 24 of the second guide groove 12 also continues from the second end portion 17 through an arc-shaped groove portion 23. Each of these arc-shaped groove portions 21 and 23 is formed obliquely upward from below so as to have a central angle of about 90°. Since the arc-shaped groove portions 21 and 23 are formed, the linear groove portions 22 and 24 are disposed at positions obliquely above the first and second end portions 16 and 17, respectively.

It can be said that the linear groove portion 22 of the first guide groove 11 and the linear groove portion 24 of the second guide groove 12 are substantially horizontally disposed as a whole, but the linear groove portions 22 and 24 are disposed so as to be slightly inclined. Specifically, the linear groove portion 22 of the first guide groove 11 is substantially horizontally formed in parallel to the upper surface or the lower surface of the body part 3, but the linear groove portion 24 of the second guide groove 12 is formed so as to gradually approach the first guide groove 11 toward the opposite side from the second end portion 17, for example, so as to be inclined at an angle θ of about 3°. Accordingly, a distance between starting end portions (portions connected to the arc-shaped groove portions) of both the linear groove portions 22 and 24 in the up-and-down direction is formed to be equal to a distance H between both the pins 13 and 14 in the up-and-down direction, but a distance between both the linear groove portions 22 and 24 in the up-and-down direction is gradually reduced toward terminating end portions. It is sufficient that an inclination angle θ between both the linear groove portions 22 and 24 is 5° at the maximum. Meanwhile, even though the first and second guide grooves 11 and 12 are parallel to each other (the inclination angle θ is 0°), the panel part 4 can be operated so as to be smoothly opened and closed without interfering with the body part 3.

Arc-shaped return groove portions 25 and 26, which have a central angle of about 180°, are formed at an end portion of the first guide groove 11 opposite to the first end portion 16 and an end portion of the second guide groove 12 opposite to the second end portion 17, respectively. Since these return groove portions 25 and 26 are curved downward from the linear groove portions 22 and 24, end portions 27 and 28 of the return groove portions 25 and 26 are disposed below the linear groove portions 22 and 24. In this case, the end portion 27 of the return groove portion 25 of the first guide groove 11 is formed in the shape of an arc-shaped terminating end having substantially the same inner diameter as the diameter of the first pin 13. The end portion 28 of the return groove portion 26 of the second guide groove 12 is also formed in the shape of an arc-shaped terminating end having substantially the same inner diameter as the diameter of the second pin 14, but a relief groove portion 29, in which the second pin 14 can be moved when the panel part is rotated about the first pin 13 present in the end portion 27 of the return groove portion 25 of the first guide groove 11, is formed so as to continue to the return groove portion 26. That is, the end portion 27 of the return groove portion 25 of the first guide groove 11 forms a rotation end portion with which the first pin 13 rotatably comes into contact (hereinafter, the end portion 27 is referred to as the rotation end portion), and the relief groove portion 29 of the second guide groove 12 is formed in the shape of an arc that has a center on the rotation end portion 27.

Meanwhile, the return groove portion 26 of the second guide groove 12 is disposed closer to the front surface of the body part 3 than the return groove portion 25 of the first guide groove 11. Accordingly, the end portion 28 of the return groove portion 26 of the second guide groove 12 is disposed closer to the front surface of the body part 3 than the end portion (rotation end portion) 27 of the return groove portion 25 of the first guide groove 11.

Further, the relief groove portion 29 of the second guide groove 12 is formed toward the opposite side from the end portion 28 of the return groove portion 26 of the second guide groove 12 and extends so as to get out of the front end face of the body part 3. Accordingly, the relief groove portion 29 forms an open end 30 through which the second pin 14 is extracted from the second guide groove 12.

Meanwhile, a relief groove portion 35 is formed at the first guide groove 11 so as to branch out from the vicinity of the end portion of the linear groove portion 22 connected to the return groove portion 25. The relief groove portion 35 includes a bent groove portion 36 that extends upward from the end portion of the linear groove portion 22 and is bent in the shape of an arc having a central angle of 90°, and a linear extension groove portion 37 that extends from the bent groove portion 36 in parallel to the linear groove portion 22. The extension groove portion 37 extends so as to get out of the front end face of the body part 3. Accordingly, the extension groove portion 37 forms an open end 38 through which the first pin 13 is extracted from the first guide groove 11. The open end 38 is formed in a tapered shape of which the width is gradually increased toward the outside.

In the audio equipment including the housing 2 formed as described above, an operation for opening the panel part 4 from the body part 3 and an operation for detaching the panel part 4 from the body part 3, that is, a panel opening operation, will be described.

Figure 4:
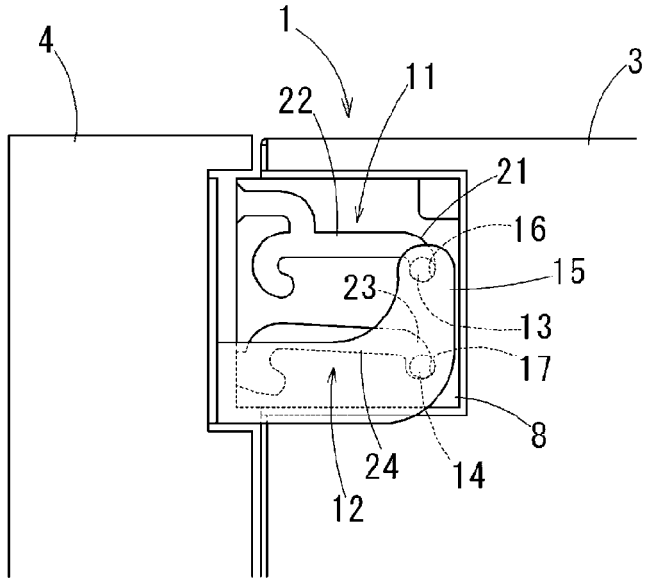
FIG. 4 is an enlarged front view of the portion corresponding to the hinge device that shows a closed state of the audio device of FIG. 2.

First, in the closed state of the panel part 4 shown in FIGS. 2 and 4, the first pin 13 is disposed at the first end portion 16 of the first guide groove 11 and the second pin 14 is disposed at the second end portion 17 of the second guide groove 12. A part of the hook 6 is exposed to the lower portion of the side surface of the panel part 4 as described above, and the hook 6 includes the unlocking button 10 connected to the hook 6. The hook 6 is fixed so as to be generally positioned on the upper side by an elastic body.

Figure 5:
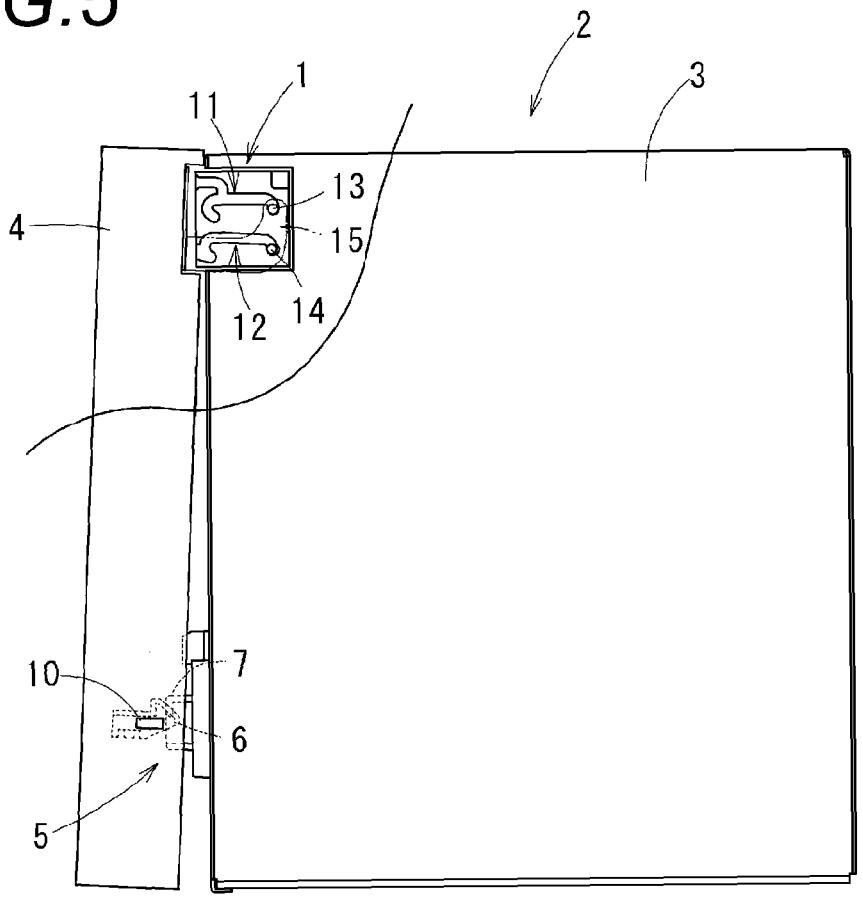
FIG. 5 is a front view that shows a state in which a panel part is unlocked by being rotated from the closed state shown in FIG. 2, and is similar to FIG. 2.
Figure 6:
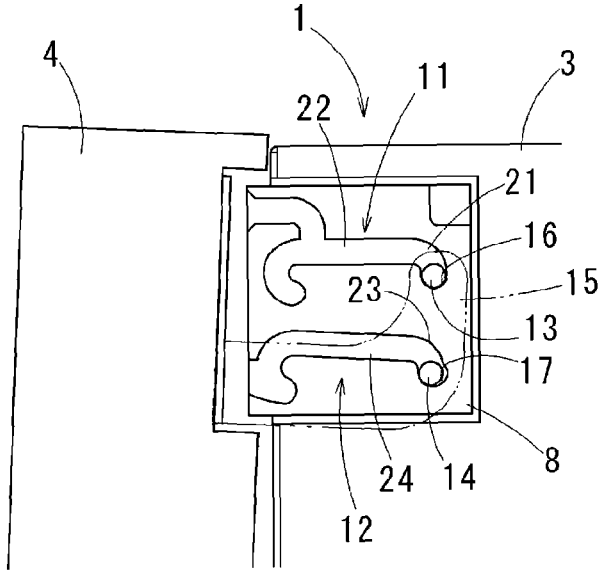
FIG. 6 is an enlarged front view of the portion corresponding to the hinge device of FIG. 5.

When the unlocking button 10 is pressed from this locked state, the hook 6 is moved slightly downward and is released from the state where the hook 6 is engaged with the locking piece 7. When the state where the hook 6 is released from the locking piece 7 is maintained, the lower end portion of the panel part 4 is slightly rotated while being pulled forward from the body part 3. When the panel part 4 is rotated, the second pin 14 is moved around the first pin 13 in the space of the second end portion 17 as shown in FIGS. 5 and 6 and the hook 6 of the panel part 4 is separated from the locking piece 7 of the body part 3 by the movement of the second pin 14. As a result, the release state of the locking device 5 is made. In the release state of the locking device 5, the lower end portion of the panel part 4 is separated from the body part 3 as shown in FIG. 5.

It is possible to smoothly perform a subsequent panel opening operation without any interference between the panel part 4 and the body part 3 as described below by separating the lower end portion of the panel part 4 from the body part 3 at the first stage of the panel opening operation in this way. Further, the movement space of the second end portion 17 is a small space, but the hinge device 1 is disposed at the upper portion of the panel part 4 and the hook 6 is disposed at the lower portion of the side surface of the panel part 4. Since the hinge device 1 and the hook 6 are disposed as described above, it is possible to ensure a moving distance, which is sufficient for the hook 6 to release the locking device 5, at the lower portion of the side surface of the panel part 4 while the second pin 14 is moved in the space of the second end portion 17.

Meanwhile, the stay 15 to which the pins 13 and 14 are fixed is shown in FIGS. 5 to 10 by a two-dot chain line.

Figure 7:
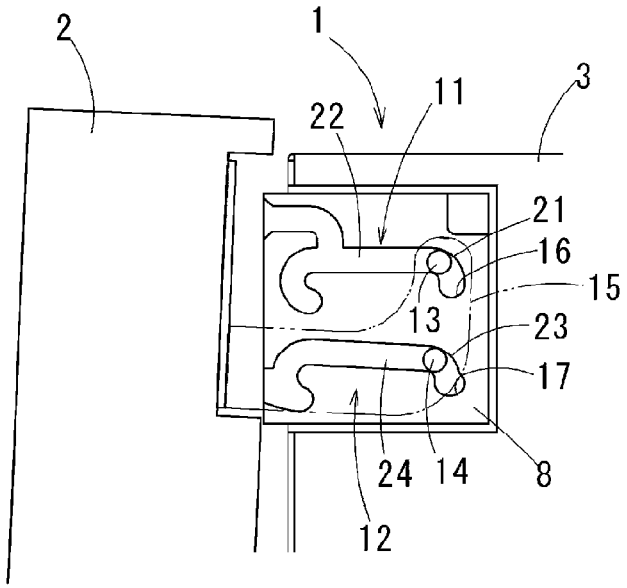
FIG. 7 is a front view showing a state in which pins are moving in arc-shaped groove portions from the state shown in FIG. 6.

Next, the panel part 4 is slid forward while being held and moved up, so that the entire panel part 4 is separated from the body part 3. At this time, as shown in FIG. 7, first, both the pins 13 and 14 of the panel part 4 are moved in the arc-shaped groove portions 21 and 23. Accordingly, the panel part 4 is moved so that the upper end of the panel part 4 floats upward from the upper end of the body part 3. As a result, the entire panel part 4 including the upper end portion thereof is separated from the body part 3.

Figure 8:
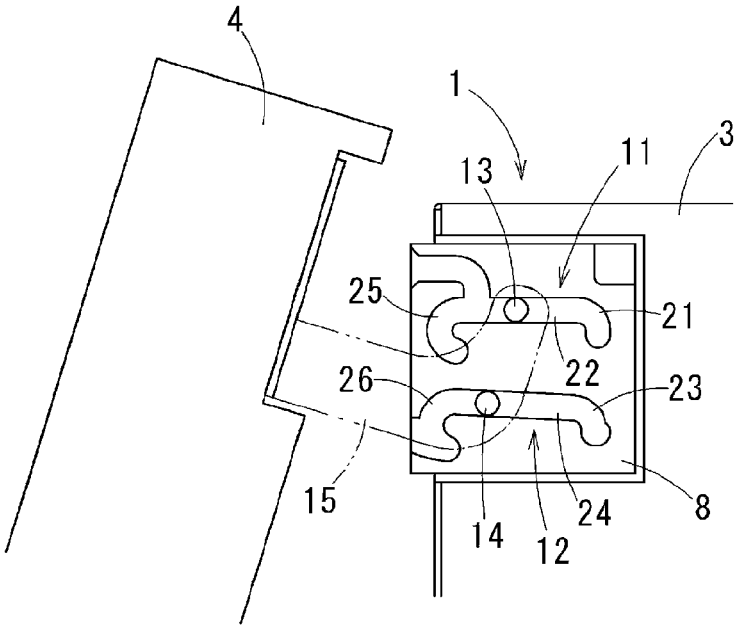
FIG. 8 is a front view showing a state in which the pins are moving in linear groove portions from the state shown in FIG. 7.

After that, when the panel part 4 slides forward as it is, the panel part 4 is gradually inclined so that the lower end portion of the panel part 4 is moved up from the body part 3 as the panel part 4 is separated from the body part 3. That is, as shown in FIG. 1, the linear groove portions 22 and 24 of the first and second guide grooves 11 and 12 are obliquely disposed so as to gradually approach each other toward the opposite side from the first and second end portions 16 and 17. Accordingly, when the first and second pins 13 and 14 are moved along the linear groove portions 22 and 24 of the respective guide grooves 11 and 12 from the arc-shaped groove portions 21 and 23 as shown in FIG. 8, the distance between both the linear groove portions 22 and 24 in the up-and-down direction gradually becomes smaller than the distance H between both the pins 13 and 14 in the up-and-down direction. Therefore, both the pins 13 and 14 are disposed so as to be gradually inclined. As a result, the panel part 4 is pulled out forward while being inclined.

Since the linear groove portions 22 and 24 of both the guide grooves 11 and 12 are obliquely disposed so that a distance therebetween in the up-and-down direction is gradually reduced as described above, the panel part 4 is gradually inclined as the panel part 4 is pulled out. Accordingly, it is possible to smoothly pull out the panel part 4 without causing the collision or the like with the body part 3 by the restriction of the careless rotation of the panel part 4.

Figure 9:
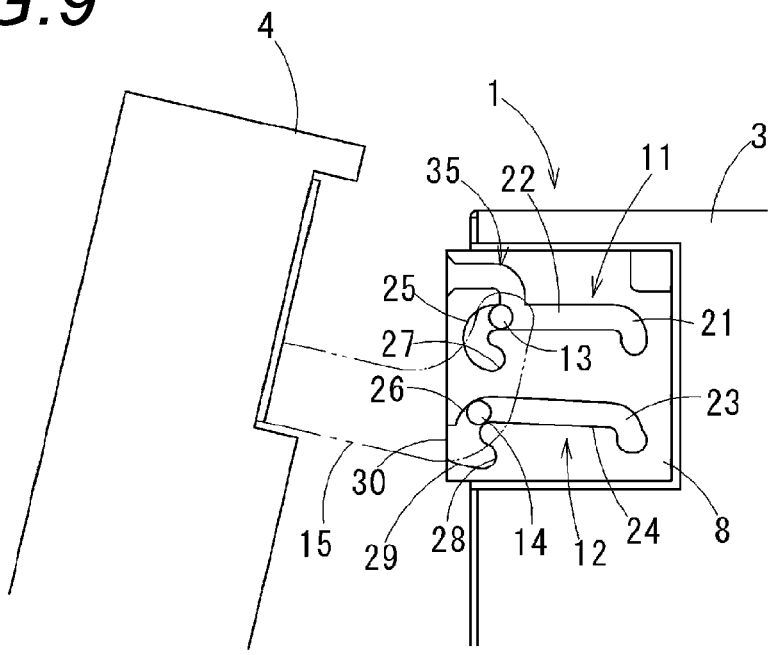
FIG. 9 is a front view showing a state in which the pins are moving in return groove portions from the state shown in FIG. 8.

After that, when both the pins 13 and 14 reach the return groove portions 25 and 26 from the linear groove portions 22 and 24 as shown in FIG. 9 with an operation for pulling out the panel part 4, the panel part 4 is moved down while the inclination angle of the panel part 4 with respect to the up-and-down direction is slightly reduced. Since the panel part 4 is significantly separated from the body part 3 in this state, the panel part 4 does not interfere with the body part 3 even though the inclination angle is reduced (even though the attitude of the panel part 4 is close to a vertical attitude).

Figure 10:
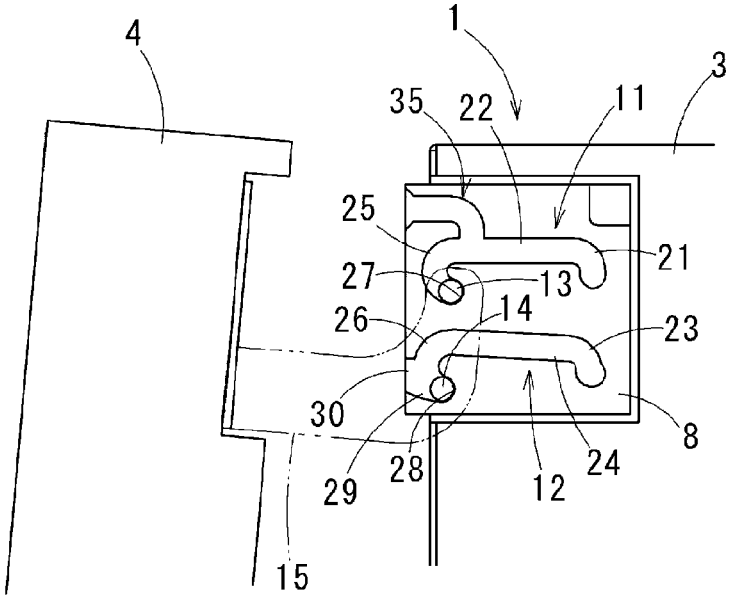
FIG. 10 is a front view showing a state in which the pins are disposed at end portions of the return groove portions from the state shown in FIG. 9.

Further, when the pins 13 and 14 come into contact with the lower end portions 27 and 28 of the return groove portions 25 and 26 as shown in FIG. 10, the panel part 4 is in a state in which the entire panel part 4 is separated from the body part 3 and is slightly inclined. Since both the pins 13 and 14 come into contact with the end portions 27 and 28 of the return groove portions 25 and 26 at this time, the weight of the panel part 4 is supported at the end portions 27 and 28. Accordingly, the panel part 4 is held at the contact positions. Since the end portion 28 of the second guide groove 12 of the end portions 27 and 28 of the return groove portions 25 and 26 is disposed closer to the front surface than the end portion 27 of the first guide groove 11 as described above, the panel part 4 is held so as to be slightly inclined.

Figure 11:
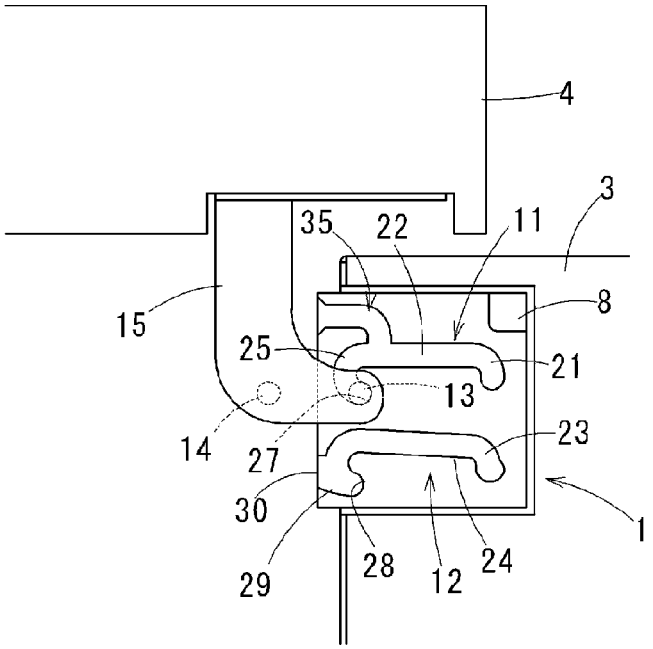
FIG. 11 is a front view showing a state in which a second pin is extracted from an open end of a second guide groove from the state shown in FIG. 10 and the panel part is opened.

Next, when the panel part 4 is rotated about the upper end portion thereof from the attitude shown in FIG. 10 so that the lower end portion of the panel part 4 is moved up, the first pin 13 is rotated in the rotation end portion 27 of the return groove portion 25 and the second pin 14 is moved in the relief groove portion 29 extending toward the opposite side from the end portion 28 of the return groove portion 26. As a result, the second pin 14 is pulled out from the open end 30. Accordingly, only the upper end portion of the panel part 4 is supported by the body part 3 as shown in FIG. 11, and the lower end portion of the panel part 4 is in a free state. Further, since the upper end portion of the panel part 4 is also separated from the body part 3, the panel part 4 does not interfere with the body part 3, for example, even though the panel part 4 is horizontally disposed.

Figure 12:
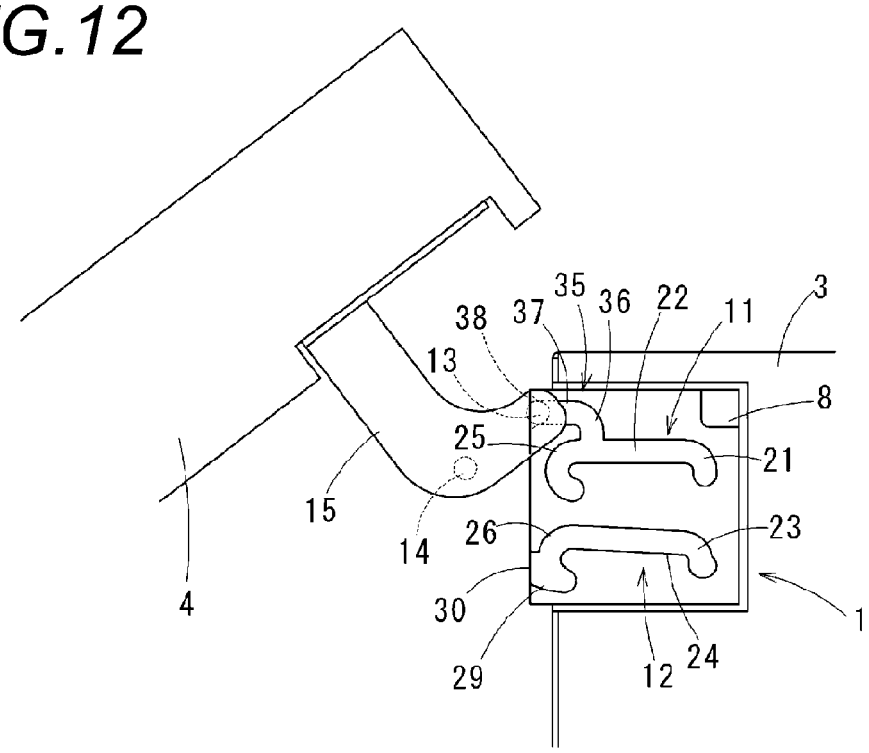
FIG. 12 is a front view showing a state immediately before a first pin is extracted from a first guide groove from the state shown in FIG. 11.

While the upper end portion of the panel part 4 is moved when the second pin 14 is removed from the second guide groove 12, the first pin 13 is moved in the return groove portion 25 in a reverse direction. After that, when the panel part 4 is pulled forward as shown in FIG. 12 after the panel part 4 is made to float and the first pin 13 is moved into the relief groove portion 35, the first pin 13 is pulled out from the open end 38, which is formed at the end of the extension groove portion 37, through the bent groove portion 36 and the extension groove portion 37 of the relief groove portion 35. As a result, the panel part 4 is separated from the body part 3.

In this case, since the panel part 4 is connected to the body part 3 by only the first pin 13, the panel part 4 is likely to be moved in the up-and-down direction and the like. Since the open end 38 of the first guide groove 11 is formed in a tapered shape, the panel part 4 can be smoothly separated from the body part 3.

As described above, it is possible to detach the panel part 4 from the body part 3 without using, particularly, a tool and the like in the hinge device 1. Further, when the transmission mechanism, such as a cable, connecting the body part 3 to the panel part 4 is removed, one surface of the body part 4 is exposed to the outside. A worker can have access to the internal structure of the body part 4 from one surface of the body part that has been exposed to the outside. Meanwhile, radio communication can be used as the transmission mechanism. In this case, the detached panel part 4 can be operated alone to transmit information to the body part 3.

Furthermore, when the detached panel part 4 is to be mounted on the body part 3, it is possible to simply mount the panel part 4 by performing the above-mentioned operation in reverse.

As already described, the lower end portion of the panel part 4 is separated from the body part 3 at the first stage of the panel opening operation in the hinge device 1. Accordingly, it is possible to easily perform a subsequent panel opening operation while holding the panel part 4 and to pull out the panel part 4 while gradually inclining the panel part 4 by the inclined linear groove portions 22 and 24. Therefore, it is possible to prevent the collision or the like of the panel part 4 with the body part 3 by the restriction of the careless rotation of the panel part 4. Further, it is possible to widely open the panel part 4 after sufficiently pulling out the panel part 4 from the body part 3, that is, to smoothly perform an operation for opening/closing the panel part 4 without causing the interfere between the panel part 4 and the body part 3 and using a tool and the like.

Furthermore, since the hinge device has a simple structure that includes two guide grooves 11 and 12 and two pins 13 and 14, it is possible to achieve a reduction in size and space saving.

Meanwhile, the present invention is not limited to the above-mentioned embodiment, and may have various modifications without departing from the scope of the present invention.

For example, in the embodiment, the panel part 4 has been adapted to be held and moved by a hand. However, the operation, which is performed until the second pin 14 is extracted from the open end 30 of the second guide groove 12, may be automatically performed using an actuator. If the actuator and the panel part are adapted to be capable of being detachably engaged with each other, it is also easy to separate the panel part from the body part.

Further, the guide grooves 11 and 12 have been formed on the surfaces, which face each other, of the two blocks 8, and both end portions of the pins 13 and 14 disposed between the blocks have been engaged with the guide grooves 11 and 12. However, one block may be disposed on each of both side portions of the body part, two pins may be supported on both side portions of the panel part, and the pins may be separately engaged with guide grooves formed on the surfaces of these blocks.

Alternatively, guide grooves of a block 8 may be guide grooves that have the shape of a long hole passing through the block 8 in a thickness direction. In this case, a pin, of which the length is longer than the length of the guide groove (long hole) in the thickness direction of the block 8 (the thickness of the block 8), may be used, the pin may be engaged with the guide groove so as to pass through the block 8, and both end portions of the pin may be held by stays. In this way, the hinge device can be formed of one block and a pair of pins.

Further, on the contrary to the embodiment, pins may be formed on the blocks 8 and the guide grooves may be formed in the stay 15. Furthermore, in the embodiment, the blocks 8 have been fixed to the body part 3 and the stay 15 has been fixed to the panel part 4. However, on the contrary, the stay 15 may be fixed to the body part 3 and the blocks 8 may be fixed to the panel part 4. That is, as long as a hinge device includes a first member on which pins are formed and a second member on which guide grooves are formed and supports fixing components of the first and second members so as to allow the fixing components to be rotatable, a portion to which the first or second member is fixed is not particularly limited.

This application is based on Japanese Patent Application No. 2012-132231 filed on Jun. 11, 2012, the contents of which are incorporated herein by reference.

REFERENCE SIGNS LIST

1: hinge device
2: housing
3: body part
4: panel part
5: locking device
6: hook
7: locking piece
8: block (first member)
9: bracket
10: unlocking button
11: first guide groove
12: second guide groove
13: first pin
14: second pin
15: stay (second member)
16: first end portion
17: second end portion
21, 23: arc-shaped groove portion
22, 24: linear groove portion
25, 26: return groove portion
27: rotation end portion
28: end portion
29: relief groove portion
30: open end
35: relief groove portion
36: bent groove portion
37: extension groove portion
38: open end

The invention claimed is:

1. A hinge device that supports a first member and a second member so as to allow the first and second members to be rotatable, the hinge device comprising:

a first guide groove and a second guide groove formed on the first member;

a first pin provided on the second member and is slidably engaged with the first guide groove; and a second pin provided on the second member and is slidably engaged with the second guide groove, wherein the first guide groove and the second guide groove respectively include a first linear groove portion and a second linear groove portion substantially parallel to each other in a first direction, the first guide groove includes a first end portion being continuous from the first linear groove portion and extending in a second direction relative to the first direction, wherein the first pin rotatably comes into contact with the first end portion, and the second guide groove includes a second end portion being continuous from the second linear groove portion and extending substantially parallel to the second direction, wherein the second end portion includes a movement space in which the second pin rotates about the first pin disposed at the first end portion of the first guide groove, and the first and second linear groove portions having respective longitudal axes that gradually approach toward each other from a side corresponding to the first and second end portions.

2. The hinge device according to claim 1, wherein the first guide groove includes a rotation end portion provided on a side of the first guide groove opposite to the first end portion, wherein the first pin rotatably comes into contact with the rotation end portion, and the second guide groove includes a first relief groove portion provided on a side of the second guide groove opposite to the second end portion, wherein the second pin rotates in the first relief groove portion about the first pin disposed at the rotation end portion.

3. The hinge device according to claim 2, wherein the first guide groove includes a first open end being connected to the rotation end portion, wherein the first pin is extracted from the first member through the first open end.

4. The hinge device according to claim 3, wherein the first guide groove includes a second relief groove portion, which guides the first pin to the first open end from the rotation end portion after the second pin is removed from the second guide groove.

5. The hinge device according to claim 2, wherein the second guide groove includes a second open end being connected to the first relieve groove portion, wherein the second pin is extracted from the first member through the second open end.

6. The hinge device according to claim 2, wherein the first guide groove includes a first arc-shaped return groove portion provided between the first linear groove portion and the rotation end portion.

7. The hinge device according to claim 6, wherein the second guide groove includes a second arc-shaped return groove portion provided between the second linear groove portion and the first relief groove portion, wherein the first and second pins are slidable in the first and second arc-shaped return grooves, respectively and simultaneously.

8. The hinge device according to claim 1, wherein the first member and the second member are locked to each other when the first pin is disposed in the first end portion and the second pin is disposed in the second end portion.

9. A housing comprising:

a body part; and a panel part that forms a front surface portion of the body part, wherein a part of any one of the body part and the panel part is the first member and a part of the other thereof is the second member, and the housing is openably and closably supported by the hinge device according to claim 1.

10. The housing according to claim 9, further comprising:

a locking mechanism to lock the panel part with respect to the body part, wherein the panel part is locked to the second member when the first pin is disposed in the first end portion and the second pin is disposed in the second end portion.

11. The housing according to claim 10, wherein the locking mechanism includes a hook provided in the panel part, a locking piece provided in the body part to engage the hook with the locking piece, and an unlocking button to release an engagement of the hook to the locking piece.

* * * * *